United States Patent [19]

Keller

[11] 3,991,570

[45] Nov. 16, 1976

[54] HYDRAULIC ACCUMULATOR PRESSURE RELEASE VALVE AND SYSTEM

[75] Inventor: James E. Keller, Vancouver, Wash.

[73] Assignee: Western Fluid Power Corporation, Portland, Oreg.

[22] Filed: Sept. 29, 1975

[21] Appl. No.: 617,399

[52] U.S. Cl. ..... 60/413; 137/115

[51] Int. Cl.[2] ..... F15B 1/02

[58] Field of Search ..... 60/413, 418, 494; 137/115

[56] References Cited

UNITED STATES PATENTS

| | | | |
|---|---|---|---|
| 2,074,618 | 3/1937 | Roeder | 137/115 X |
| 3,353,495 | 11/1967 | Bianchetta | 60/413 X |

*Primary Examiner*—Edgar W. Geoghegan

*Attorney, Agent, or Firm*—Klarquist, Sparkman, Campbell, Leigh, Hall & Whinston

[57] ABSTRACT

A hydraulic power supply unit has a fluid reservoir and a motor-driven pump which delivers fluid under pressure to a hydraulic system through a check valve in a fluid supply line. A hydraulic pressure accumulator downstream of the check valve helps maintain the system under a predetermined pressure. An accumulator pressure release valve automatically relieves the accumulator and thus the connected system of hydraulic pressure when the pump is inactive. The valve has a valve body with a pilot port connected to the discharge side of the pump upstream of the check valve, an accumulator port in communication with the accumulator and a return port in communication with the reservoir. Internal passages within the valve body interconnect the pilot, accumulator and return ports. A movable valve member within the valve body moves to a closed position when the pump operates to block flow from the accumulator port to the return port, thereby pressurizing the accumulator and the system. Opposed surfaces of the movable valve member in its closed position are subjected, respectively, to pump discharge pressure acting through the pilot port and accumulator pressure acting through the accumulator port. These opposed surfaces are of unequal areas with the surface exposed to pilot pressure being of larger area so as to maintain the valve member in its closed position after the accumulator is fully charged. However, when the pump is deactivated so that no pressure acts through the pilot port, system pressure acting through the accumulator port moves the valve member to its open position to release accumulator and system pressure, reducing it to zero.

11 Claims, 3 Drawing Figures

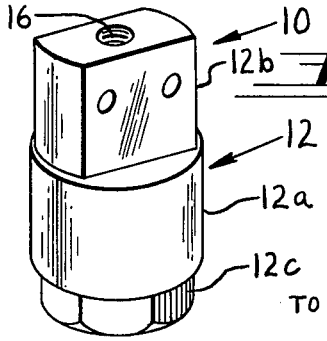
Fig 1
Fig 2
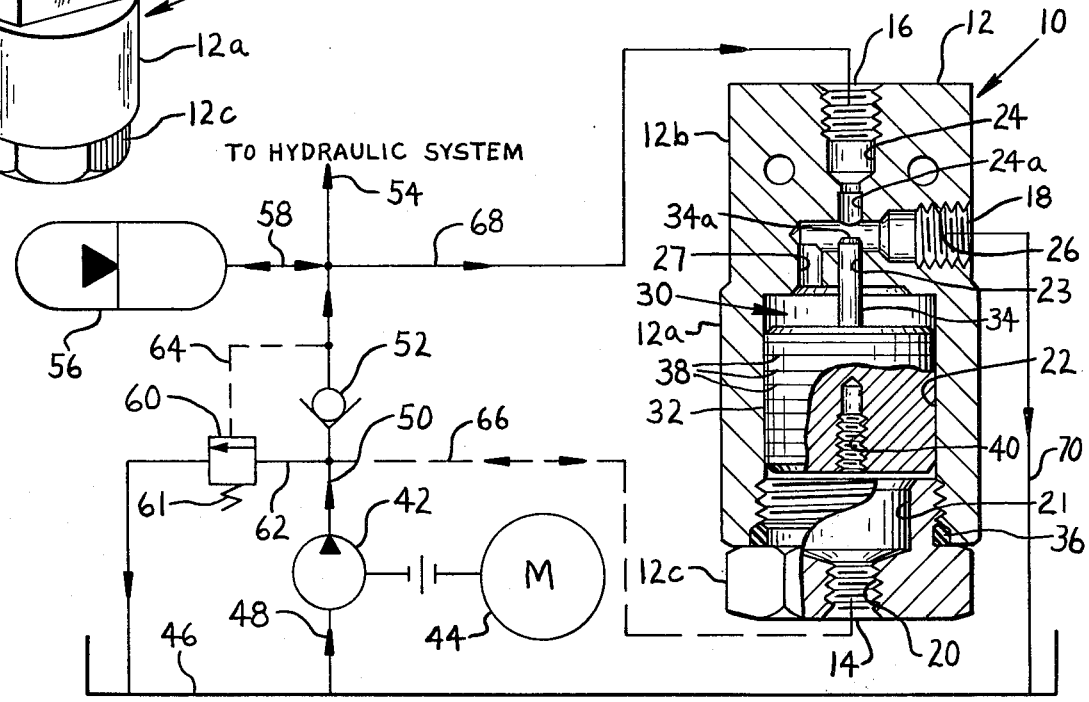
Fig 3
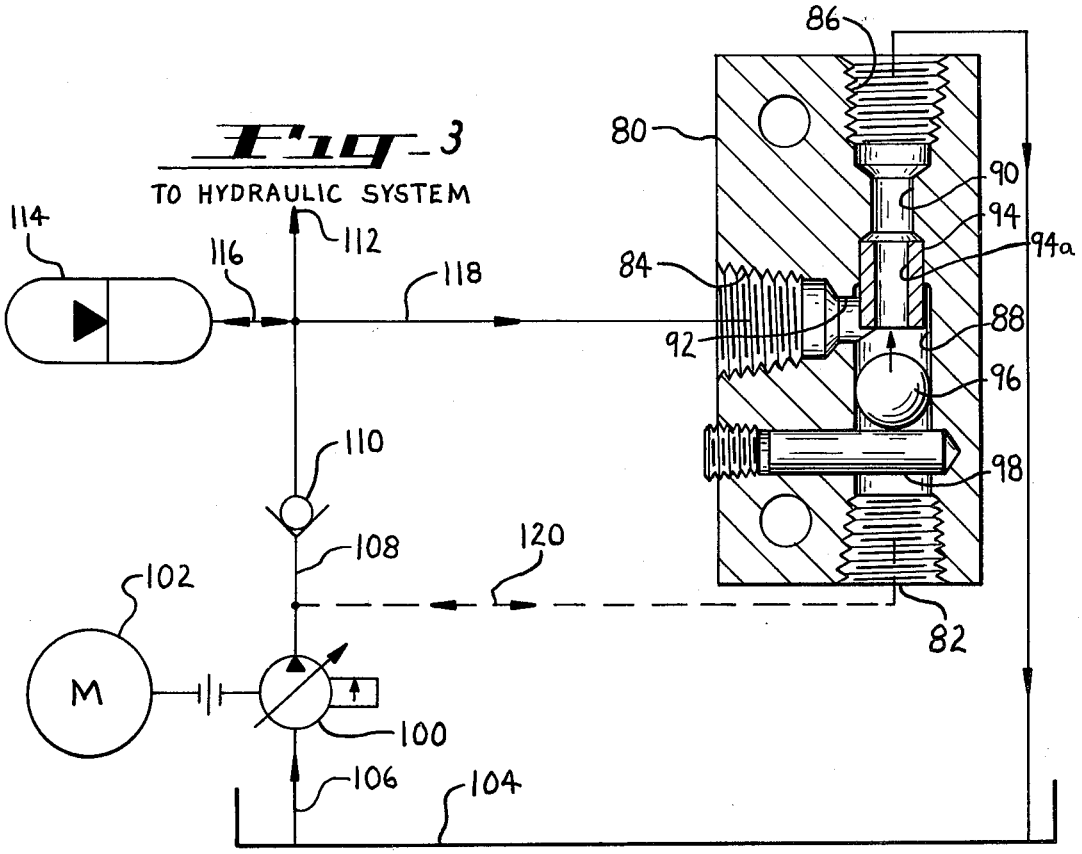

HYDRAULIC ACCUMULATOR PRESSURE RELEASE VALVE AND SYSTEM

BACKGROUND OF THE INVENTION

1. Field of the Invention

The present invention relates to a hydraulic accumulator pressure release valve and more particularly to such a release valve that is hydraulically operated.

2. Description of the Prior Art

Hydraulic pressure accumulators are commonly used in hydraulic power systems to help maintain system pressure despite variations in demand or pump discharge pressures. As a safety measure, it is desirable to include an accumulator pressure release valve in such a hydraulic power system to release accumulator and system pressure whenever the system's pump is deactivated. Without such a release valve, the accumulator maintains residual pressure in the system even though the system appears to be inoperative because the pump is shut off. Under such circumstances someone cleaning or maintaining hydraulically operated tools or machinery could inadvertently actuate the system, possibly damaging it or causing bodily injury.

Although accumulator pressure release valves are commonly used in such hydraulic systems, in the past such valves have been electrically operated. Electrically operated valves naturally require a separate electrical system for their operation, adding significantly to the cost of the hydraulic power supply unit and rendering the functioning of such valves dependent on the functioning and reliability of the electrical system.

SUMMARY OF THE INVENTION

In accordance with the present invention the deficiencies of the prior art are overcome by providing an accumulator pressure release valve which is hydraulically operated by the hydraulic pressure system in which it is used and which is automatically operated to release system pressure when the hydraulic pump for the system stops.

The hydraulic pressure release valve of the invention embodies a valve body having a pilot port for receiving fluid under pump discharge pressure, an accumulator port in communication with the hydraulic accumulator and system pressure and a return port in communication with the hydraulic fluid reservoir. Internal passages within the valve body connect the three ports. A valve member is movable within one such passage between an open position providing communication between the accumulator and return ports and a closed position blocking communication between such ports. A first surface area of the movable valve member exposed to pump discharge pressure through the pilot port is larger than a second, opposed surface area of such valve member exposed to accumulator pressure acting through the accumulator port. These unequal surface areas produce unequal forces to maintain the valve member closed so long as the pump remains operating. However, when the pump stops operating, the pressure at the pilot port drops to zero so that system pressure which continues acting through the accumulator port moves the valve system to its open position, thereby reducing the accumulator and hydraulic system pressure to zero.

A primary object of the invention is therefore to provide an accumulator pressure release valve which is operated solely by the hydraulic pressure of the system in which it is used.

A second primary object of the invention is to provide an accumulator pressure release valve which operates automatically to release all hydraulic pressure from a connected accumulator and hydraulic system when the pump for such system is deactivated.

Other primary objects of the invention are to provide a release valve which is simple, inexpensive, reliable, rugged and virtually maintenance free.

The foregoing and other objects and advantages of the present invention will become more apparent from the following detailed description which proceeds with reference to the accompanying drawings.

BRIEF DESCRIPTION OF THE DRAWINGS

In the drawings:

FIG. 1 is a perspective view of one form of hydraulic accumulator pressure release valve in accordance with the invention;

FIG. 2 is a longitudinal sectional view of the valve of FIG. 1 with internal portions of such valve subsectioned for clarity and showing the valve connected schematically in a hydraulic power supply circuit for a hydraulic system;

FIG. 3 is a sectional view through a modified form of accumulator pressure release valve shown connected schematically in a modified form of hydraulic power supply circuit.

DETAILED DESCRIPTION

FIG. 1 Form of Valve

Referring first to FIGS. 1 and 2, a hydraulic accumulator pressure release valve 10 of the invention includes a valve body or block 12 including a cylindrical main body portion 12*a*, a generally rectangular end portion 12*b* extending from one end of main body 12*a*, and a cap portion 12*c* threaded into the opposite end of main body 12*a* and provided with external wrenching surfaces.

The valve body is provided with three port means including a pilot port 14 at one end, an accumulator port 16 at the opposite end, and a fluid return port 18 at one side of body end portion 12*b*. These three ports are interconnected by internal passage means within the valve body including a pilot passage portion 20 extending inwardly from pilot port 14 through port cap 12*c* to an enlarged pressure cavity portion 21 within a threaded stem of the port cap. Cavity portion 121 in turn leads into an enlarged piston cavity portion 22 within the main valve body portion 12*a*. The piston cavity portion 22 leads into a much smaller spool passage portion 23 which is aligned and connected with an accumulator passage portion 24 leading inwardly of valve body portion 12*b* from accumulator port 16. The described internal passage portions form a first continuous axial bore from end to end of the valve body. This bore is intersected by additional internal passage means comprising a second transverse bore 26 leading inwardly from return port 18 and extending past the axial bore where it intersects a pressure relief passage port 27 leading from the inner end of piston cavity 22

A movable valve means 30 is mounted within the valve body and includes a large diameter piston 32 movable within cavity 22 and a much smaller diameter spool 34 movable within spool passage 23 and the small innermost end 24*a* of accumulator passage 24. Although the spool and piston are not interconnected, they move together between an open position as shown in FIG. 2 in which accumulator ports 16 and return port 18 are in fluid communication with one another through internal passages 24 and 26 and a closed position in which internal communication between such ports is blocked. In the closed position of such movable valve members the inner end of piston 32 bottoms against the innermost end of piston cavity 22 and spool 34 enters the reduced inner end 24*a* of accumulator passage 24, thereby blocking internal communication between accumulator port 16 and return port 18.

The outer end surface of piston 32 comprises a first pressure surface area which is exposed to pilot pressure entering the valve body through pilot port 14 of valve cap 12*c*. Similarly the outer end 34*a* of valve spool 34 comprise a second pressure surface area smaller than the first which is exposed to any fluid pressure entering the valve body through is exposed to any fluid pressure entering the valve body through accumulator port 16. Because the outer end surface 34*a* of spool 34 is much smaller in area than the opposed piston outer end surface, a greater total force acts on the piston end than on the opposed spool end, maintaining the piston and spool in their closed positions. Because of the great disparity between the opposed end surface areas of the piston and spool, even a considerably smaller pressure acting on the piston end surface than on the opposed spool end surface is sufficient to maintain such valve members in their closed positions.

The three ports 14, 16 and 18 of the valve body are preferably internally threaded as shown to provide a suitable threaded connection for receiving externally threaded hydraulic hose couplings. The external wrenching surfaces of end cap 12*c* provide for easy removal of the end cap for access to the piston cavity for insertion and removal of the piston and spool from the valve body. A suitable O-ring seal 36 is provided between a shoulder portion of cap 12*c* and the mating valve body portion 12*a* to prevent the leakage of hydraulic fluid from the valve body at this point. The cylindrical surface of piston 32 has annular oil balancing grooves 38 so that the piston will respond as intended to changing pressure conditions at the valve ports. The outer end surface of the piston also has a central internally threaded recess 40 for facilitating removal of the piston from the valve body using an externally threaded removal tool.

Pressure release valve 10 is suitable for use in either the hydraulic fluid power supply circuit of FIG. 2 or the slightly different fluid power supply circuit of FIG. 3. However, its application will be described with respect to the hydraulic power supply circuit of FIG. 2.

Such circuit includes a fixed displacement fluid pump 42 driven by a prime mover 44. The pump draws fluid from the hydraulic fluid supply resevoir 46 through a suction line 48 and discharges it under pressure into a primary fluid supply line 50 and through a check valve 52 to a connected hydraulic system indicated generally at 54 served by the hydraulic power supply unit shown. The circuit also includes the hydraulic pressure accumulator 56 connected by a branch fluid line 58 to the primary fluid supply line 50 downstream of check valve 52.

The supply circuit also includes a differential pressure unloading relief valve 60 in a return line 62 leading from main supply line 50 upstream of check valve 52 back to reservoir 46. Relief valve 60 is biased to its closed position shown by a spring 61 and is sensitive to system pressure downstream of check valve 52 through a pilot line 64. When pump 42 is operating and accumulator 56 fully charged, valve 60 is moved to an open position to short circuit pump discharge back to reservoir 46 through bypass line 62 when system pressure is at a predetermined maximum level. Spring 61 of valve 60 recloses the relief valve when system pressure downstream of the check valve drops to a level somewhat below the maximum desired system pressure. For example, if desired system pressure is 1,000 psi, relief valve 60 opens when downstream system pressure reaches such level, but recloses when such system pressure drops to a level of, for example, 850 to 900 psi.

A pilot fluid line 66 branches from the fluid supply line 50 upstream of check valve 52 and is connected to pilot port 14 of release valve 10. Another branch fluid supply line 68 branches from the primary supply line 50 downstream of check valve 52 and is connected to accumulator port 16 of release valve 10. A fluid return line 70 leads from return port 18 of release valve 10 back to reservoir 46.

Operation of FIG. 1 Valve

With pump 42 deactivated the pressure in the hydraulic circuit of FIG. 2 both upstream and downstream of check valve 52 is zero. In this condition of the circuit both spool 34 and piston 32 of the movable valve means 30 are in their open positions shown.

When the prime mover 44 is energized to activate pump 42, hydraulic fluid discharge pressure from the pump 42 is transmitted through primary fluid supply line 50, pilot line 66 and pilot port 14 of release valve 10 to act on the outer end surface of piston 32, forcing the piston inwardly to its bottomed position within valve cavity 22. Piston 32 pushes the smaller diameter spool 34 from its open position shown toward the accumulator port 16 until it enters accumulator passage portion 24*a*, blocking communication between accumulator port 16 and fluid return port 18. With return port 18 blocked, fluid flow from pump 42 through primary supply line 50 and check valve 52 charges accumulator 56 and hydraulic system 54 with fluid under pressure. The accumulator 56 acting in conjunction with relief valve 60 maintains system pressure at a desired level.

With valve 60 fully closed, the fluid pressures acting on the opposed ends of the spool and piston should be substantially equal. However, because of the larger surface area of the outer end of piston 32, a larger force is developed at such surface than at the opposed end surface of the spool, thereby maintaining the piston in its bottomed or closed position so as to continue to block fluid flow through valve 10 to the reservoir. Even when valve 60 is partially or fully open to reduce pump discharge pressure and thus the pilot pressure acting through port 14 on the piston, the total force acting on the piston is greater than the opposed force acting on the spool because of the piston's much greater end surface area. Therefore the piston and spool remain in their closed positions so long as the pump remains operating.

However, when the prime mover is stopped, deactivating pump 42, hydraulic pressure in the lines upstream of check valve 52 is gradually reduced to zero because of internal leakage across the ports of the pump. When this occurs, system pressure downstream of the check valve acting through line 68 and valve port 16 against the outer end of spool 34 produces a greater force than the now-zero force acting against the opposed end surface of piston 32, shifting the spool 34 out of accumulator passage 24*a* and pushing piston 32 toward the outer end of its cavity 22. This opens communication between accumulator passage 24 and return passage 26 within valve body 12 so that fluid from the hydraulic system can flow to the reservoir through release valve 10 and from its return port 18, reducing system and accumulator pressure to zero. When this occurs, the movable valve members 32 and 34 remain in their open positions shown until the pump is restarted because of the balanced conditions of the piston and spool.

FIG. 3 Valve Form

FIG. 3 shows a modified form of accumulator pressure release valve particularly adapted for use in the hydraulic power supply circuit of FIG. 3.

The release valve of FIG. 3 is of simplified form and includes a rectangular valve block 80 having a pilot port 82 at one end, an accumulator port 84 at one side, and a return port 86 at the opposite end, all internally threaded to receive suitable fluid hose coupling. The three ports are interconnected by internal valve passage means including a pilot passage section 88, a return passage portion 90, and an accumulator passage portion 92. The pilot and return passage portions are formed by a single through bore extending from end to end of the valve block 80 in line with the accumulator and pilot ports. The accumulator passage 92 is formed by a second bore intersecting the first bore between the opposite ends of the latter. A cylindrical valve seat 94 providing an internal passage 94*a* of reduced diameter is positioned within the first-mentioned bore offset just slightly toward the return port 86 from the intersection between the three internal passage portions so as not to block communication between such three passage portions. A movable valve member comprising a spherical valve ball 96 is positioned within pilot passage 88 and is retained therein by a retaining pin 98. The valve ball is movable between an open position shown providing communication between the accumulator port 84 and return port 86 and a closed position in which it is seated on valve seat 94 to block fluid flow through the sea passage 94*a* between accumulator port 84 and return port 86.

Valve 80 is particularly adapted for use in the hydraulic power supply circuit of FIG. 3 having a pressure-compensated variable displacement pump 100 producing a constant discharge pressure when driven by a prime mover 102. Such pump when operating draws hydraulic fluid from a fluid reservoir 104 through its suction line 106 and discharges it through a primary fluid supply line 108 and a check valve 110 to a hydraulic system 112 to be served.

As in the circuit of FIG. 2, the circuit of FIG. 3 has a hydraulic pressure accumulator 114 downstream of check valve 110 connected to the primary fluid supply line 108 and the system through a branch line 116. A second branch line 118 downstream of check valve 110 leads from primary supply line 108 to accumulator port 84 of release valve 80. A pilot line 120 leads from the primary fluid supply line 108 upstream of check valve 110 to pilot port 82 of release valve 80.

Operation of FIG. 3 Form of Valve

In operation, prime mover 102 drives pump 100 which is pressure compensated to provide a constant output pressure at a variable pump displacement. Accordingly the differential pressure unloading relief valve used in the hydraulic power supply circuit of FIG. 2 is unnecessary in the circuit of FIG. 3. Therefore pump discharge pressure acting through pilot line 120 at pilot port 82 of the pressure release valve will normally be the same as system pressure downstream of check valve 110 acting through branch line 118 at a accumulator port 84 of the release valve.

When the pump 100 is not operating, pressure in all portions of the hydraulic circuit is zero and valve ball 96 is in its open position shown.

However, when the prime mover 102 is started to activate pump 100, pump discharge pressure acting through pilot line 120 and pilot port 82 against valve ball 96 forces such ball against valve seat 94, closing its internal passage 94*a* and thus blocking flow between accumulator port 84 and return port 86. Therefore continued operation of pump 100 charges accumulator 114 and the hydraulic system 112 with fluid under pressure determined by the discharge pressure of the pump.

System pressure acts through line 118 and accumulator port 84 against a pressure surface area of the seated valve ball 96 in opposition to the pilot pressure acting on an opposed surface of the ball through pilot port 82. Although these pressures are substantially equal, the pressure surface area against which the pressure at accumulator port 84 acts is less than the pressure surface area against which the pressure at pilot port 82 acts because of the seated condition of the valve ball. Therefore the total force acting on the ball through pilot port 82 is greater than the total opposed force acting on the opposite side of the ball through accumulator port 84, maintaining the ball against its seat.

However, when the pump stops, the pressure in the circuit upstream of check valve 110 recedes to zero because of internal leakage across the ports of the pump. Therefore the pressure at pilot port 82 of release valve 80 is correspondingly reduced. However, because of check valve 110 and accumulator 114, system pressure remains high and continues to act through line 118 and accumulator port 84 of the release valve on the unseated surface area of the ball exposed to such pressure. Thus system pressure forces the ball away from its seat toward its retaining pin, opening communication between accumulator port 84 and return port 86, releasing fluid from the system back to reservoir 104 and reducing system and accumulator pressure to zero.

Having illustrated and described the principles of my invention with reference to what are presently two preferred forms of the invention, it should be apparent to those persons skilled in the art that such embodiments are capable of modification in arrangement and detail without departing from such principles. I claim as my invention all such modification as come within the true spirit and scope of the following claims.

I claim:

1. An accumulator pressure release valve for a hydraulic power supply means having a hydraulic fluid pump for supplying fluid under pressure from a source of hydraulic fluid through a check valve to a hydraulic power system in which a hydraulic pressure accumulator helps maintain system pressure, said accumulator pressure release valve comprising:

a valve body, pilot port in said valve body for communication with the discharge side of said pump between said pump and said check valve, an accumulator port in said valve body for communication with said hydraulic accumulator, a return port in said valve body for communication with said hydraulic fluid source, internal valve passage means in said valve body interconnecting said pilot, accumulator and return ports, a movable valve means movable within said internal valve passage means between an open position enabling fluid communication between said accumulator port and said return port and a closed position blocking fluid communication between said accumulator port and said return port, said movable valve means in both said open and closed positions having a first pressure surface area in fluid communication with said pilot port and a second pressure surface area opposed to said first pressure surface area in fluid communication with said accumulator port, said first pressure surface area in said closed position being greater than said opposed second pressure surface area such that upon operation of said pump fluid pressure acting through said pilot port against said first pressure surface area maintains said movable valve means in its closed position to maintain system and accumulator pressure and upon deactivation of said pump fluid pressure acting through said accumulator port against said second pressure surface area moves said movable valve means to its open position to release system and accumulator pressure.

2. A valve according to claim 1 wherein said movable valve means comprises a valve ball and said internal passage means includes a valve seat between said accumulator port and said return port against which said valve ball becomes seated in said closed position to block fluid communication between said accumulator port and said return port.

3. A valve according to claim 2 including ball-retaining means in said valve body at said internal passage means between said pilot port and said valve seat to retain said valve ball within said valve body while permitting movement of said ball between said open and closed position.

4. A valve according to claim 3 wherein said internal valve passage means comprises a first bore extending continuously through said valve body from one end thereof at said pilot port to the opposite end thereof at said return port and a second bore extending transversely of said first bore from said accumulator port and intersecting said first bore intermediate the length of said first bore, said valve seat being positioned at the intersection of said bores.

5. A valve according to claim 1 wherein said movable valve means comprises a valve piston movable within said internal passage means and a valve spool engageable at one end thereof with one end of said piston also movable within said internal passage means, the opposite end of said piston being in fluid communication only with said pilot port in both said open and closed positions, the opposite end of said spool being smaller in surface area than the opposite end of said piston and being in fluid communication only with both said accumulator and return ports in said open position and being in fluid communication only with said accumulator port in said closed position.

6. A valve according to claim 5 wherein said pilot port is at one end of said valve body, said accumulator port is at an opposite end of said valve body and said return port is at one side of said valve body.

7. A valve according to claim 6 wherein said internal passage means includes a continuous straight bore extending from said pilot port to said accumulator port and includes an enlarged piston cavity portion and a reduced spool passage portion, and a second bore extending transversely of said first bore from said return port and intersecting said first bore and being in continuous fluid communication with said enlarged piston cavity portion.

8. A valve according to claim 5 wherein said piston and spool are separate cylindrical elements and said piston is of substantially larger diameter than said spool.

9. In a hydraulic power supply unit having a hydraulic fluid pump, a source of hydraulic fluid for said pump, a primary fluid supply passage means for delivering fluid under pressure from said pump to a hydraulic power system, a check valve in said primary supply passage means permitting fluid flow from said pump to said system, a hydraulic pressure accumulator charged from said primary supply passage means downstream of said check valve, and a release valve means for releasing accumulator and system pressure upon deactivation of said pump, the improvement comprising:

a pilot passage in fluid communication with the discharge side of said pump between said pump and said check valve, an accumulator passage in fluid communication with said accumulator, a return passage in fluid communication with said source, said release valve means controlling communication between said accumulator passage and said return passage, said release valve means including a movable valve means movable between an open position providing fluid communication between said accumulator passage and said return passage and a closed position blocking fluid communication between said accumulator passage and said return passage, said movable valve means having a first pressure surface area in fluid communication with said pilot port and a second pressure surface area in opposition to said first pressure surface area in fluid communication with said accumulator port in both said open and said closed positions, said second pressure surface area being smaller than said first pressure surface area at least in said closed position of said movable valve means whereby said valve means is maintained in its closed position when said pump operates and moves to its open position to release system pressure when said pump stops operating.

10. A hydraulic power supply unit according to claim 9 wherein said pump is a pressure compensated variable displacement pump for providing a constant pressure output through said check valve to said hydraulic power system.

11. A hydraulic power supply unit according to claim 9 wherein said pump is a fixed displacement pump providing a variable pressure output and including a high pressure relief valve means sensitive to system pressure downstream of said check valve, said relief valve means being operable to short-circuit fluid flow from the discharge side of said fixed displacement pump to said hydraulic fluid source upstream of said check valve when said system pressure downstream of said check valve reaches a predetermined high pressure level and being operable to block said short-circuit flow when system pressure downstream of said check valve is at a pressure level below said predetermined high pressure level, said movable valve means comprising a piston movable within said internal passage means, and a spool engageable at one end with one end of said piston also movable within said internal passage means, the opposite end of said piston being in fluid communication with said pilot port, the opposite end of said spool being in fluid communication with said accumulator port, said opposite end of said piston having a substantially larger surface area than said opposite end of said spool, said spool being moved by said piston into a position blocking flow between said accumulator and return ports upon operation of said pump, and said spool being moved by fluid pressure acting through said accumulator port to a position enabling fluid communication between said accumulator and return ports when said pump ceases to operate.

* * * * *

UNITED STATES PATENT AND TRADEMARK OFFICE

CERTIFICATE OF CORRECTION

PATENT NO. : 3,991,570

DATED : November 16, 1976

INVENTOR(S) : James E. Keller

It is certified that error appears in the above-identified patent and that said Letters Patent are hereby corrected as shown below:

Column 1, line 64, "system" should be --member--;
Column 2, line 50, "121" should be --21--;
Column 2, line 62, "port" should be --portion--;
Column 3,line 17, "comprise" should be --comprises--;
Column 3, lines 19-20, delete "is exposed to any fluid pressure entering the valve body through";
Column 5, line 27, "section" should be --portion--;
Column 5, line 47, "sea" should be --seat--;
Column 6, line 12, delete "a";
Column 6, line 31, after "opposed" insert --pressure--.

Signed and Sealed this

Twenty-second Day of February 1977

[SEAL]

*Attest:*

RUTH C. MASON
*Attesting Officer*

C. MARSHALL DANN
*Commissioner of Patents and Trademarks*